United States Patent [19]

Aschermann

[11] Patent Number: 4,513,965

[45] Date of Patent: Apr. 30, 1985

[54] BASEBALL BAT INSTRUCTION ACCESSORY UNIT

[76] Inventor: Kurt Aschermann, 1573 East Main Street, Mohegan Lake, N.Y. 10547

[21] Appl. No.: 589,619

[22] Filed: Mar. 14, 1984

[51] Int. Cl.[3] ..... A63B 69/40

[52] U.S. Cl. ..... 273/26 R

[58] Field of Search ..... 273/26 R, 29 A, 26 E, 273/84, 67, 58 C

[56] References Cited

U.S. PATENT DOCUMENTS

| | | | |
|---|---|---|---|
| 1,973,424 | 9/1934 | Albera | 273/26 R |
| 2,765,170 | 10/1956 | Brown | 273/26 E |
| 3,341,200 | 9/1967 | Brandley | 273/26 E |
| 3,921,976 | 11/1975 | Lane | 273/26 R |
| 3,942,794 | 3/1976 | Gowins | 273/26 E |
| 4,022,467 | 5/1977 | Ruess | 273/29 A |
| 4,089,521 | 5/1978 | Berst et al. | 273/587 |

*Primary Examiner*—Richard C. Pinkham
*Assistant Examiner*—T. Brown
*Attorney, Agent, or Firm*—Wolder, Gross & Yavner

[57] ABSTRACT

A baseball bat instruction accessory unit to teach the proper technique for hitting a baseball. The unit is held by an instructor and includes a handle or gripping portion, a connecting portion and an impact portion, which is essentially perpendicular to the gripping portion. The unit is made of still sheathing material, such as plastic, with the impact portion highlighted, as by white or brightly surface treatment. The sheathing material allows the instructor to "feel" the quality of the swing by the pupil. Alternatively, the hollow core of the sheathing material may contain wooden or metal dowels to withstand high impact forces and provide more stiff resiliency. The dowel may be made in two parts, spaced from each other to prevent the full effect of the impact forces being felt by one holding the handle.

1 Claim, 6 Drawing Figures

22
24
42
44
3
3
16
10
2
2
18
19
40

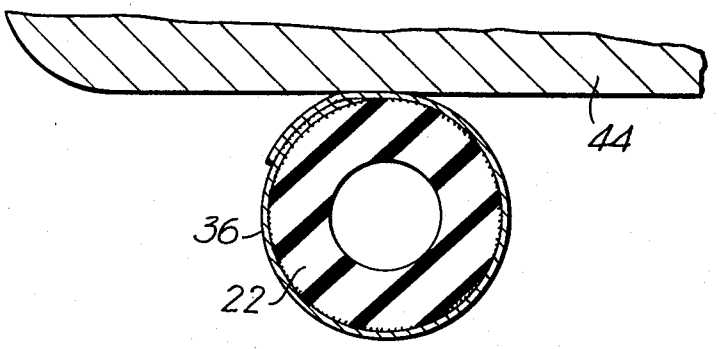
FIG. 3
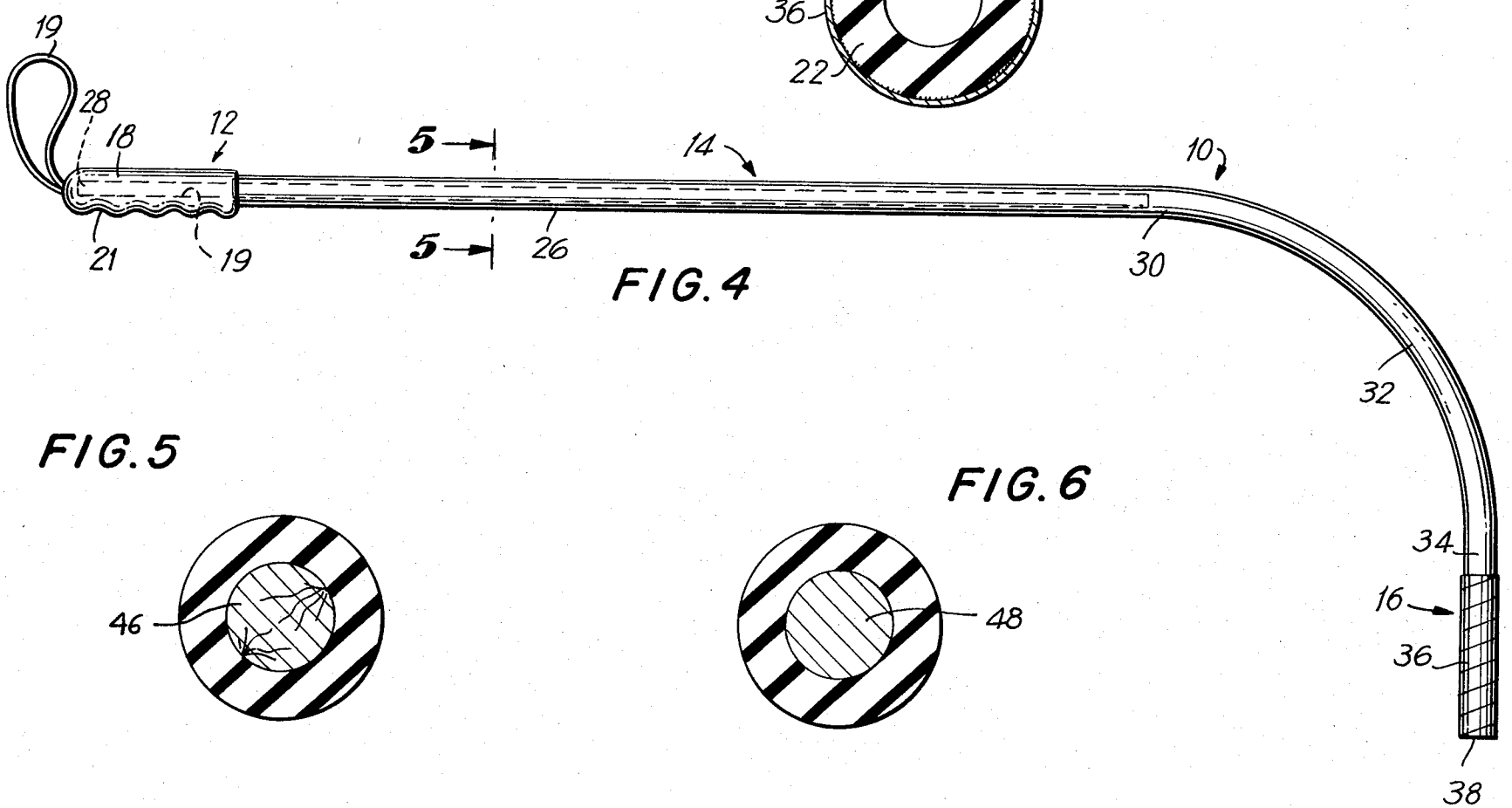
FIG. 4
FIG. 6
FIG. 5

BASEBALL BAT INSTRUCTION ACCESSORY UNIT

BACKGROUND OF THE INVENTION

The present invention relates to instructional aids for teaching a pupil how to properly swing a baseball bat, and more particularly is directed to such a unit designed to be directly held by the instructor.

Ever since the development of modern baseball, the teaching of the proper swing of a baseball bat has been a major area of delay with respect to a pupil's or student's ability to properly learn the game. The initial technique was to throw a ball towards the batter and allow the batter to swing. This required continuous swinging and required a pitcher capable of placing the ball in the appropriate location at all times. None of these ideals could ever be achieved, so many pitches were required to place a ball in the proper location even just several times. Furthermore, such a technique required either a catcher or a backstop so that the ball would not be lost or go a significant distance from the batter if the batter did not hit it. If the pupil did hit the ball, then it had to be retrieved before the next pitch and swing could be effected.

With the advent of Little League baseball, the need to teach younger and younger students became important. One of the techniques used was to have a large tee upon which a ball could be placed. This would leave the ball in a stationary position, but the tee had to be constantly adjusted depending on the different height of the pupil; and after the ball was hit, it had to be retrieved or if the ball wasn't hit properly it had to be retrieved to be replaced upon the tee. This technique also made it somewhat difficult to judge the quality of the swing of the pupil.

Accordingly, among the objects of the present invention is to provide an improved baseball bat instruction accessory unit.

Still a further object of the present invention is to provide an improved instruction unit which would be much more efficient, by allowing a greater number of analyzed swings during a time period than is possible by use of prior art techniques.

Still yet a further object of the present invention is to provide an instruction unit of the character described which will simplify teaching techniques.

Still yet another object of the present invention is to provide a baseball bat instruction accessory unit which will be simple and economical to manufacture, and yet be durable to a high degree in use.

BRIEF DESCRIPTION OF THE PRESENT INVENTION

The present invention is directed to an improved baseball bat instruction accessory unit which is basically, in its simplest form, a piece of hose, such as an ordinary garden hose. One end of the hose has a gripping portion consisting of a handle placed thereon. The handle is designed to be held by either one or two hands of the batting instructor. The connecting portion of the hose simply extends outwardly and eventually curves over and terminates in an impact portion. The impact portion may be round, or may be flat. The impact portion is usually, in extent, the diameter of a baseball and may be highlighted, as by white surface. In use, the impact portion is substantially perpendicular to the gripping portion.

The pupil then approaches the instructor and is instructed on the proper swinging technique and swings at the impact portion of the unit. The manner in which the bat meets the impact portion results in a certain quality of swing. This quality is transmitted through the unit to the gripping portion and can be felt by the instructor. Therefore, the instructor is in an immediate position to analyze the quality of the swing. Alternatively, it is possible to place wooden or metal dowels within the opening in the center of the sheathing material or hose in order to add to the rigidity of the unit and allow the unit to withstand higher impact forces.

The above description, as well as further objects and advantages of the present invention, will be more fully appreciated with reference to the following detailed description of a preferred, but nonetheless illustrative, embodiment of the invention, when taken in conjunction with the following drawings, wherein:

FIG. 3 is an enlarged, partly cut away, cross-sectional view taken along the lines 3—3 of FIG. 1;

FIG. 4 is a side elevational view of the unit;

FIG. 5 is an enlarged cross-sectional view taken along the lines 5—5 of FIG. 4, and showing a wooden dowel in position within the sheathing material; and FIG. 6 is a view similar to FIG. 5 but showing a metal dowel positioned within the sheathing material in an alternative embodiment;

DETAILED DESCRIPTION OF THE DRAWINGS

Figures 1, 2:
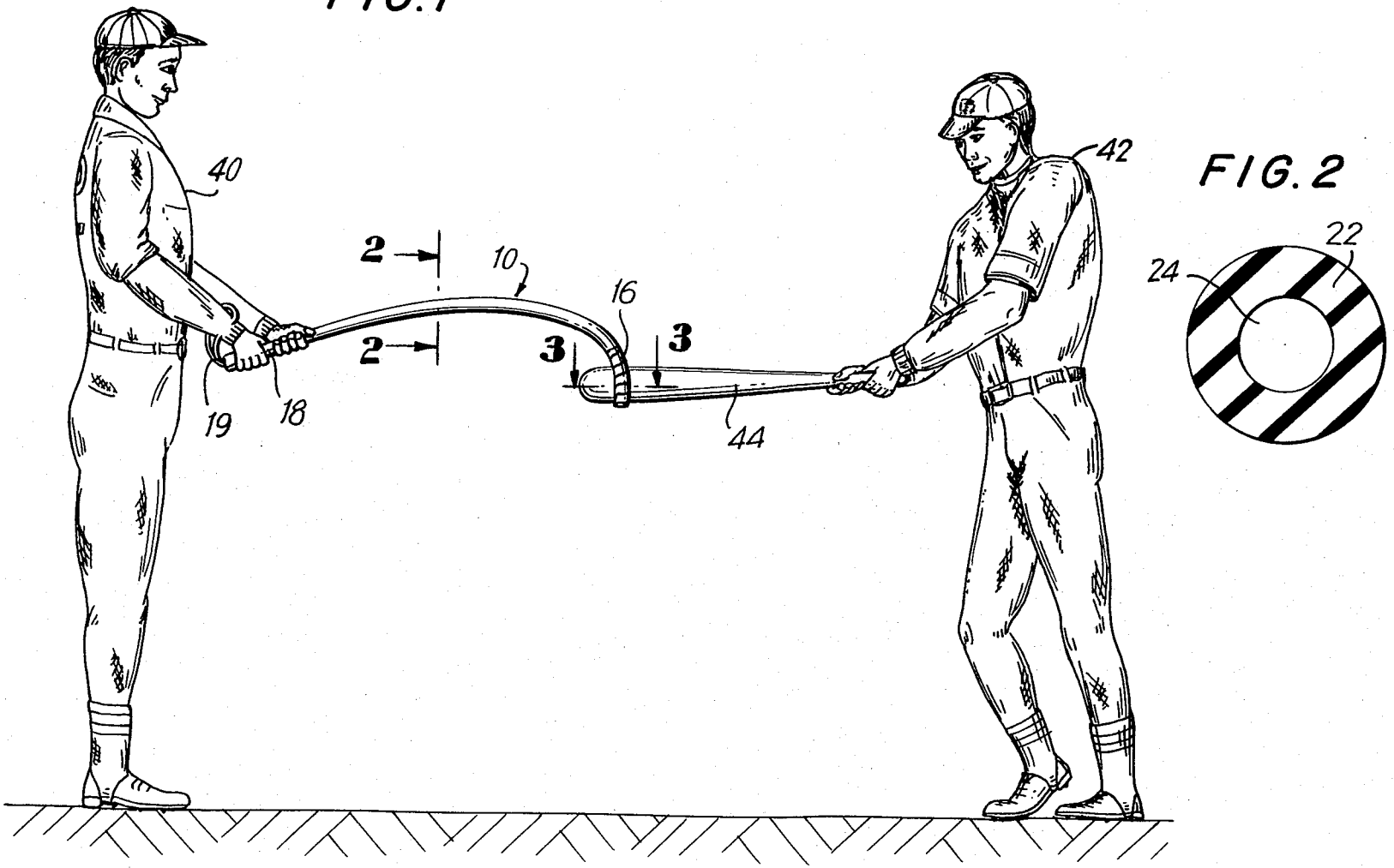
FIG. 1 is a perspective view of the batting instructor and student utilizing the baseball bat instruction accessory unit embodying my new invention.
FIG. 2 is an enlarged cross-sectional view taken along the lines 2—2 of FIG. 1.

Turning now to the drawings, and more particularly to FIG. 4, there is shown an embodiment of my baseball bat instruction accessory unit 10 broadly comprising a gripping portion 12, a connecting portion 14, and an impact portion 16.

More specifically, the impact portion has a handle 18 with an opening 19 defined therein. The handle may be of a sufficient length to accommodate one or two hands. In the embodiment shown, it is of sufficient length length to accommodate one hand, and has a standard finger gripping surface 21.

The connecting portion may be made of sheathing material, with a near end and a far end, such as standard garden hose, or any other material which, as best seen in FIG. 2 in cross-section, has a cylindrical portion 22 with a center hole 24 defined therein.

Turning again to the connection portion 14, there is a substantially straight section 26, of which one end 28 is received within the hole 19 of the handle 18. The section 26 is substantially in alignment with the major axis of the handle 18. The section 26 eventually blends into a slightly curved section 30 and then a sharply curved section 32, so that the hose starts to form a significant angle to the axis of the handle 18. The curved section 32 blends into a bridge section 34 which terminates at the impact portion 16. The impact portion 16 can be a further extension of the sheathing material. The impact portion generally defines a surface 36. The surface may be white or any other color, and formed by tape or the like, as long as the impact portion is clearly delineated. Generally, the impact portion may be three or more inches. It is designed to approximate the diameter of a baseball, whether it be a hard ball or a soft ball. The impact portion is generally round, especially if it is an extension of the sheathing material, but it may also be flat (not shown) without changing the scope of the invention. The impact portion terminates in the end 38 of the unit.

Turning to FIG. 1, the unit is held by the batting instructor 40 in the manner shown. As may be seen particularly in FIG. 1, the proximate end of the unit 10, as to the instructor 40, includes a strap 19, which warps about the instructor's wrist for safety reasons. In this picture, the instructor is holding the handle 18 which is capable of accommodating both of his hands. As seen, the unit 10 is held so that the impact portion 16 is basically perpendicular to the main axis of the handle 18. The pupil 42 swings the bat 44 in the prescribed manner and hits the impact portion 16. The batting instructor 40, since he is facing the pupil, is immediately able to analyze the swing technique of the pupil. Furthermore, because the bat hits the impact portion 16, the quality of the impact can be "felt" by the batting instructor since the forces will travel through the sheathing material to the gripping handle and hence to the hands of the instructor.

In order to allow the batting instructor to withstand greater impact forces, and to provide stiff resiliency, a wooden dowel 46 (FIG. 5) may be placed within the center hole 24 generally along the substantially straight section 26 of the connecting portion 14. It is also possible to place a metal dowel 48 within the hole 24, and then even higher impact forces may be accommodated by the batting instructor without discomfort.

It is also possible to further increase the forces without increasing the discomfort felt by the batting instructor by removing a section of the dowel at some point along the straight section 26 (not shown), and thus the forces will not be transmitted directly through the dowel from the distal end of the dowel into the handle portion.

As can be seen, the present invention provides a significant advance over the status of the technology. As numerous additions, modifications and constructions can be performed within the scope of the invention, such scope is to be measured by the claims herein.

What is claimed is:

1. A baseball bat instruction accessory unit to teach the proper technique for hitting a baseball, which comprises:

(a) a gripping portion to allow the unit to be held by the batting instructor;

(b) a connecting portion defining a near end and a far end, said near end secured to the gripping portion, and a curved section so that the far end is not in axial alignment with the gripping portion; and (c) an impact portion secured to the far end of the connecting portion, said impact portion having an impact designating means to present an appropriate target to the pupil, said connecting portion being formed of hollow sheathing material and having a dowel positioned therein, the dowel being in two parts, the parts spaced from each other, in order to prevent the full effect of the impact forces traveling from the distal part of the dowel into the gripping handle.

* * * * *